US011596204B1

(12) United States Patent
Hays

(10) Patent No.: US 11,596,204 B1
(45) **Date of Patent: *Mar. 7, 2023**

(54) SHOE GARMENT SYSTEM

(71) Applicant: Deyona Elaine Hays, Mounds, OK (US)

(72) Inventor: Deyona Elaine Hays, Mounds, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/160,227

(22) Filed: Jan. 27, 2021

(51) Int. Cl.

| | |
|---|---|
| ***A43B 3/18*** | (2022.01) |
| ***A43C 19/00*** | (2006.01) |
| ***A43B 23/30*** | (2006.01) |
| ***A43C 11/00*** | (2006.01) |

(52) U.S. Cl.
CPC ..... *A43B 23/30* (2013.01); *A43B 3/18* (2013.01); *A43C 11/006* (2013.01); *A43C 19/00* (2013.01)

(58) Field of Classification Search
CPC ..... A43B 3/18; A43B 23/227; A43B 23/28; A43B 23/30; A43C 11/006; A43C 19/00
USPC ..... 36/1.5
See application file for complete search history.

(56) References Cited

U.S. PATENT DOCUMENTS

| | | | | |
|---|---|---|---|---|
| 1,820,679 | A * | 8/1931 | Sawyer | A43B 5/007 36/72 B |
| 2,422,055 | A * | 6/1947 | Varon | A41D 17/00 36/2 R |
| 8,001,706 | B2 | 8/2011 | Jeffers | |
| 9,867,421 | B2 * | 1/2018 | Teichert | A43B 3/16 |
| 10,413,018 | B2 | 9/2019 | Kenison | |
| 10,863,789 | B2 * | 12/2020 | Webb | A43B 3/24 |
| 2011/0078919 | A1 | 4/2011 | Yang | |
| 2013/0097893 | A1 * | 4/2013 | Rabinovitch | A43B 3/0078 36/136 |
| 2013/0326907 | A1 | 12/2013 | Ahanotu | |
| 2015/0128457 | A1 * | 5/2015 | Wright | A43B 23/30 36/72 B |
| 2015/0250266 | A1 | 9/2015 | Alas | |

FOREIGN PATENT DOCUMENTS

| | | | | |
|---|---|---|---|---|
| GB | 2492898 A * | 1/2013 | | A43B 5/007 |

* cited by examiner

*Primary Examiner* — Sharon M Prange
(74) *Attorney, Agent, or Firm* — Plager Schack LLP; Mark H. Plager; Naomi Mann

(57) ABSTRACT

A shoe garment may have a generally tubular body and include a heel slot generally configured to receive heel, a bottom support slot configured to encircle a portion of the shoe and/or foot, and a top support slot configured to encircle approximately at or above the user's ankle. The shoe garment may be used to secure the shoe to the foot, improve fit, provide an alternate style option, and/or provided added support and/or warmth to the user.

5 Claims, 7 Drawing Sheets

SHOE GARMENT SYSTEM

BACKGROUND

The embodiments herein relate generally to devices and methods for improving shoe wear. Particular embodiments may relate to such devices and methods for heeled shoes.

Certain shoe styles, and particularly high heeled shoes may often not fit a user properly and/or fail to provide proper foot support in a shoe. This may cause the shoe to slip or twist off of a user's foot causing discomfort and even injury. As such, there is a need for an improved shoe fitting system.

SUMMARY

According to various embodiments, disclosed is a shoe garment system for heeled, including high heeled shoes, comprising a shoe garment and a method for wearing a shoe using the shoe garment.

In embodiments, the shoe garment may generally be formed as a sleeve or tubular body, configured to envelope a portion of the shoe and/or foot to secure the shoe to the foot. The shoe garment may comprise a heel slot, which may be an opening within the shoe garment that is configured to receive a heel of a shoe. The garment may further comprise a bottom support slot, which may be an opening in the shoe garment generally configured to encircle a portion of the shoe and foot of a user; and a top support slot.

In some embodiments, the shoe garment may envelope the shoe and foot, simultaneously. In some further embodiments, the garment may envelope the wear's ankle and/or leg. The garment may further comprise a heel opening through which the shoe heel may be inserted to hold the garment in place around the shoe and foot. Thus, the garment may engage around the heel and upper portion of the shoe and the user's foot, ankle and/or leg. Additionally, the garment may comprise a stretchable material, for providing a snug and adaptable fit.

According to various embodiments, a method for wearing a heeled shoe may comprise inserting the shoe heel into a heel slot of a shoe garment, and inserting a foot into the shoe through a top support slot of the heel garment, wherein the shoe garment may be configured to wrap around at least a portion of the shoe, and may further wrap around an exposed portion of the foot. In some embodiments, the method may further comprise pulling the shoe garment over at least a portion of the shoe.

The disclosed shoe system may provide added foot support and stability to the wearer, and may help prevent the foot from slipping out of the shoe. The garment and method may further enhance comfort and/or decrease foot pain to the wearer, provide ankle and/or leg support, and may further provide warmth. Additionally, the garment and method may change the appearance of the shoe to provide an alternative and/or enhanced style option.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

In the following detailed description of the invention, numerous details, examples, and embodiments of the invention are described. However, it will be clear and apparent to one skilled in the art that the invention is not limited to the embodiments set forth and that the invention can be adapted for any of several applications.

Figure 1:
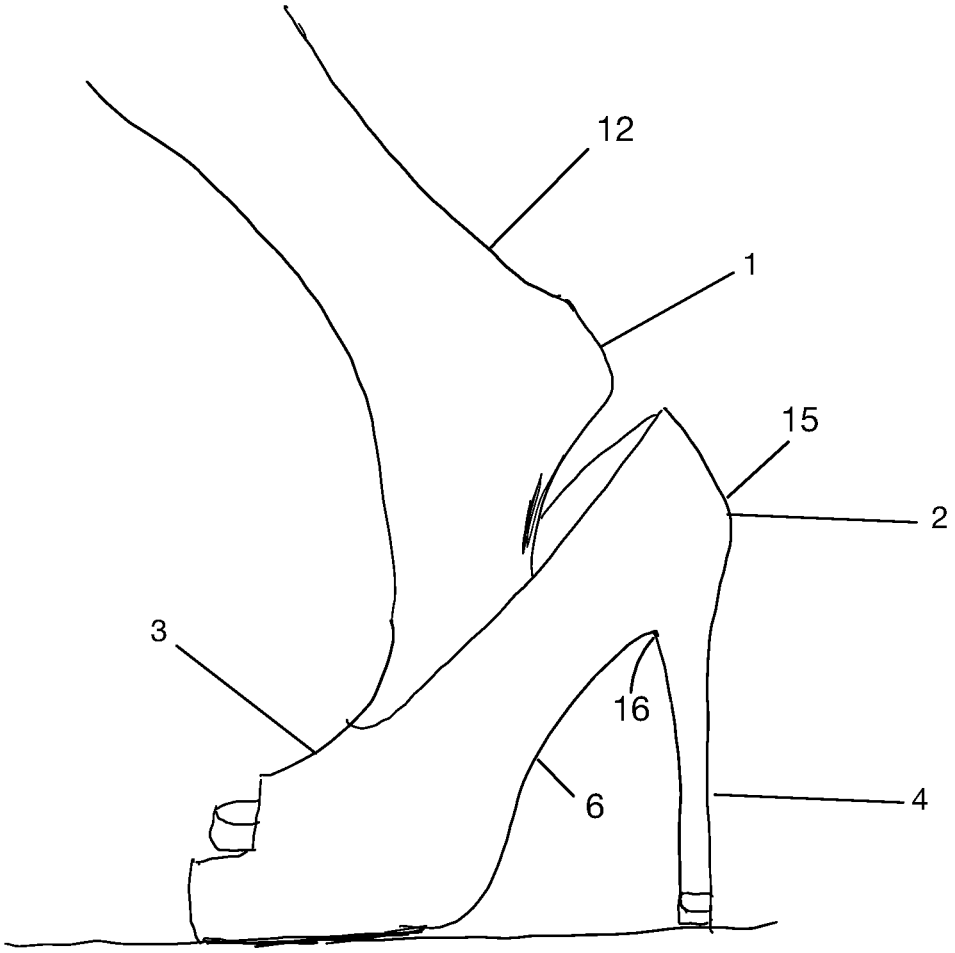
FIG. 1 (Prior Art)
FIG. 1 illustrates a high heeled shoe of the prior art, depicting how a user's foot may slip out of the shoe.

Heeled shoes come in a wide variety of styles. Generally, a heeled shoe 2 may comprise a heel 4, coupled to the underside of shoe sole 6 at the rear of the shoe. The shoe 2 may further comprise one or more pieces of an upper 3 and/or straps, coupled to the sole 6 to secure a wear's foot 1 to the sole 6. However, some shoes may fail to properly secure the foot and may have an increased risk of having the foot slip out of the shoe (see FIG. 1). This may be due to factors such as shoe style, lack of proper fit, stretching out of the shoe, etc. This may be particularly true for high heeled and/or styled shoes, wherein the upper may not fully cover the foot, and wherein the weight of the foot is heavily shifted towards the front of the shoe. While shoe inserts and/or various fillers may be used in some cases to further tighten the fit of some shoes, such devices may cause discomfort and pain by creating concentrated pressure points, and/or over tightening the fit. Additionally, such devices may fail to provide the needed adjustment for preventing the shoe from slipping off of the foot.

According to various embodiments, the disclosed subject matter provides a shoe garment, and a shoe garment method which may provide added foot support and stability to the wearer, and may help prevent the foot from slipping out of the shoe. In embodiments, the disclosed shoe garment and method may further enhance comfort and/or decrease foot pain to the wearer. Furthermore, the disclosed shoe garment may provide benefits such as ankle and/or leg warmth and general ankle/leg support, and as such, may be used for therapeutic purposes. Additionally, the disclosed garment and method may enable a user to change the appearance of the shoe for an alternative and/or enhanced style option.

As depicted in FIGS. 2-7, the disclosed shoe garment 5 may be configured to anchor to the heel 4 of the shoe 2, and wrap around a portion of the shoe. In embodiments, garment 5 may further wrap around an exposed portion of the foot. In some embodiments, the garment 5 may further wrap around the ankle, and/or leg. According to various embodiments, shoe garment 5 may be made of a stretchable material, including various stretchable fabrics, which may be natural and/or synthetic. It shall be appreciated that while a specific style high heeled shoe is depicted in the figures, the disclosed shoe garment 5 can be used with shoes of a variety of styles.

Figure 2:
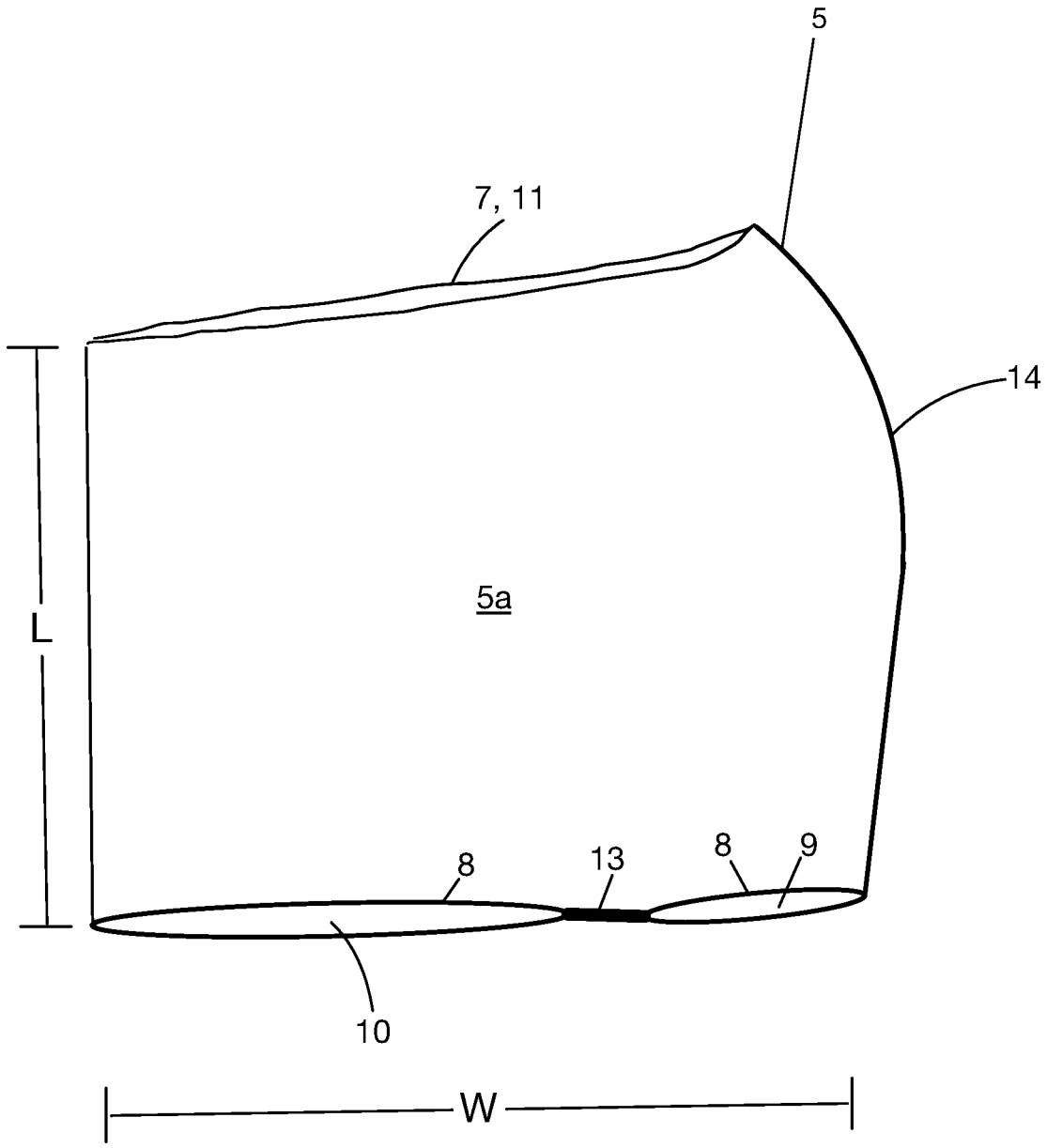
FIG. 2 illustrates a shoe garment, according to certain embodiments.

In embodiments, the shoe garment 5 may have a generally tubular body 5*a*, defining a length "l" and a flat diameter or width "w", as shown in FIG. 2. The garment 5 may further comprise a top opening 7, and a bottom opening 8. In some embodiments, tubular body 5*a* may include contoured section(s) 14, which may conform to the curvature of the shoe 2.

In embodiments, shoe garment 5 may include a heel slot 9, which may be an opening generally configured to receive heel 4. In further embodiments, garment 5 may include a bottom support slot 10, which may be an opening generally configured to encircle a portion of the shoe 2. In embodiments, bottom support slot 10 may encircle the shoe and exposed portion of the foot simultaneously. In further embodiments, garment 5 may include a top support slot 11, which may be an opening generally configured to encircle approximately above the heel of the user's foot, or approximately at or above the user's ankle 12.

In some embodiments, heel slot 9 and bottom support slot 10 may be formed within bottom opening 8 via a seamed section 13 in bottom opening 8. As best depicted in FIG. 2, seamed section 13 may be a joinder of opposite sections on the circumference of bottom opening 8. In some embodiments, seamed section 13 may comprise of a thread sewn seam between the opposite sections, and which attaches the sections. As shown in the figures, seamed section 13 creates a separation within bottom opening 8 that defines the heel slot 9 and bottom support slot 10 on opposite sides of seamed section 13. According to various embodiments, the width ratio of the bottom support slot 10 to heel slot 9, may generally be greater than 1:1, or at about 2:1, or at about 3:1, or at about 4:1, or greater. Additionally, top support slot 11 may be defined by top opening 7, according to various embodiments.

Figure 3:
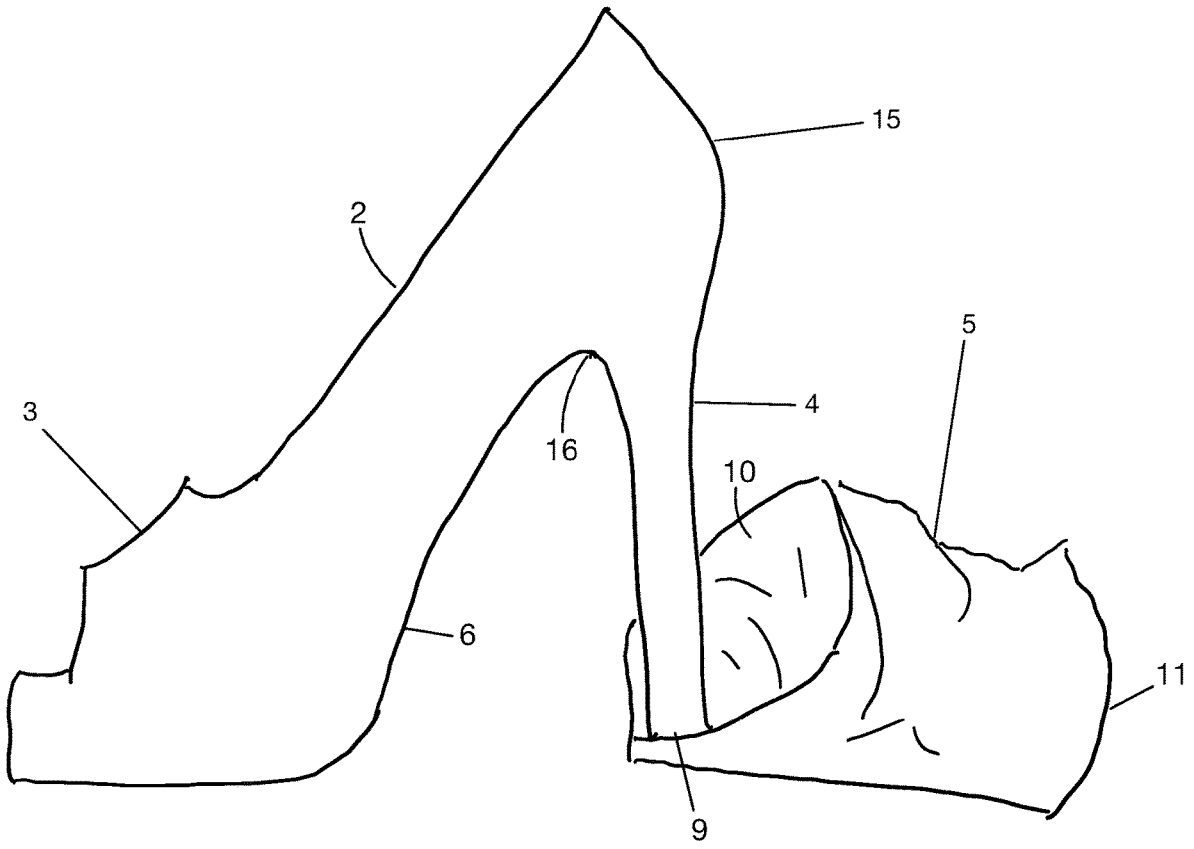
FIG. 3 illustrates a heel of the shoe placed into the shoe garment.
Figure 4:
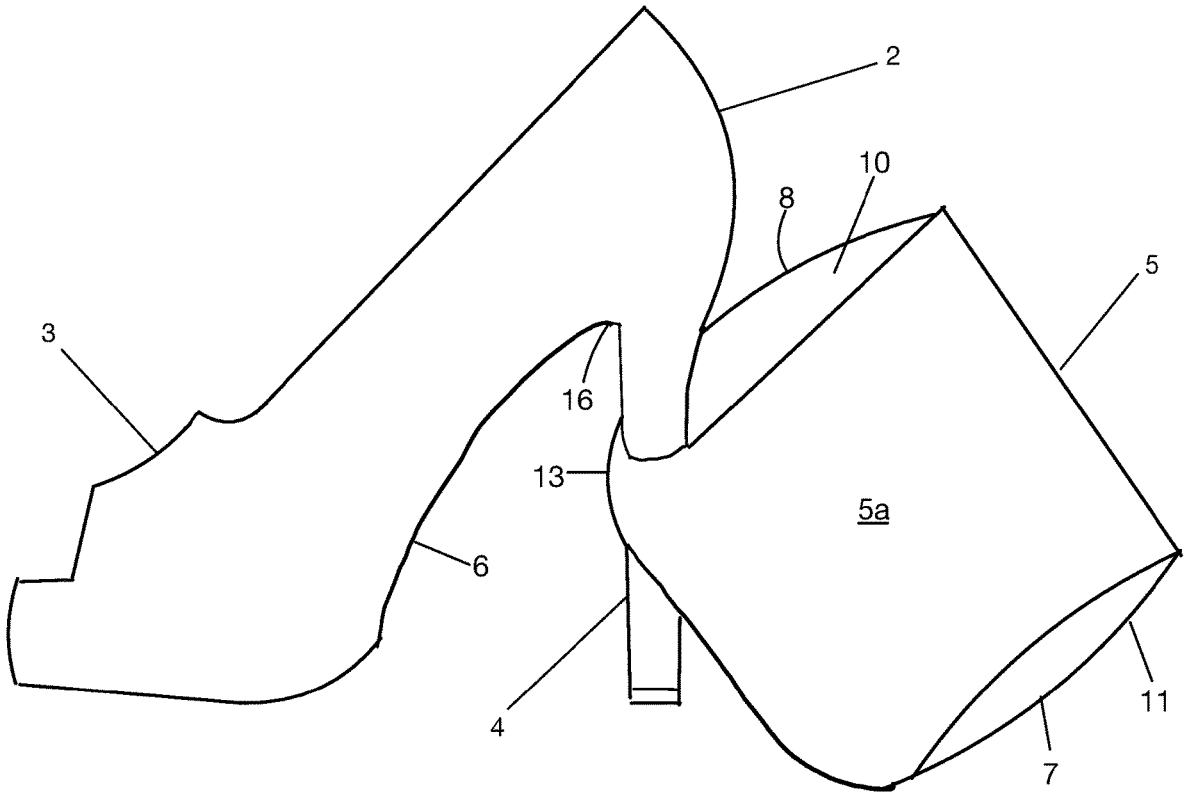
FIG. 4 illustrates the shoe garment pulled over the heel.
Figure 5:
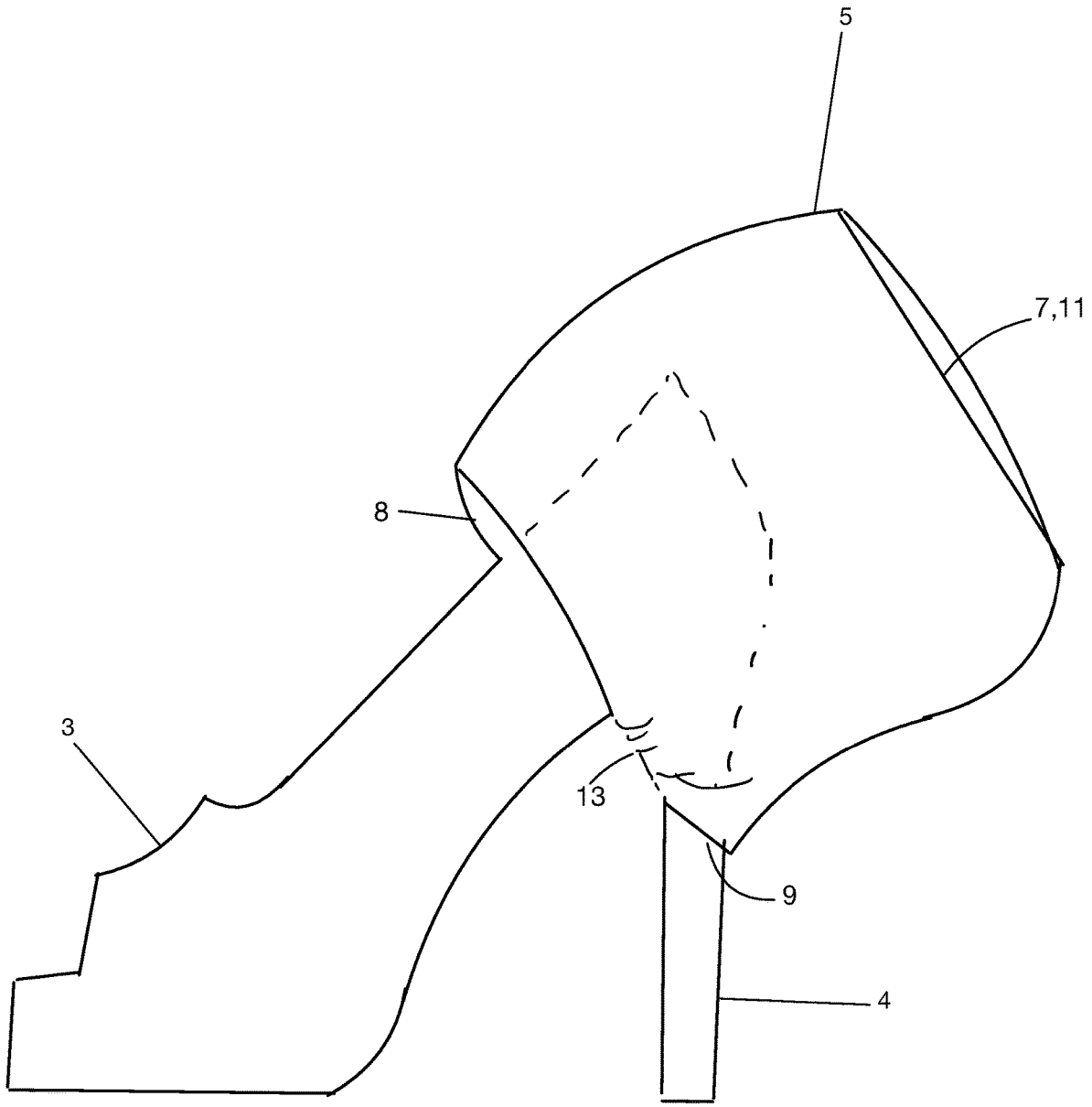
FIG. 5 illustrates the shoe garment pulled over the upper shoe.
Figure 6:
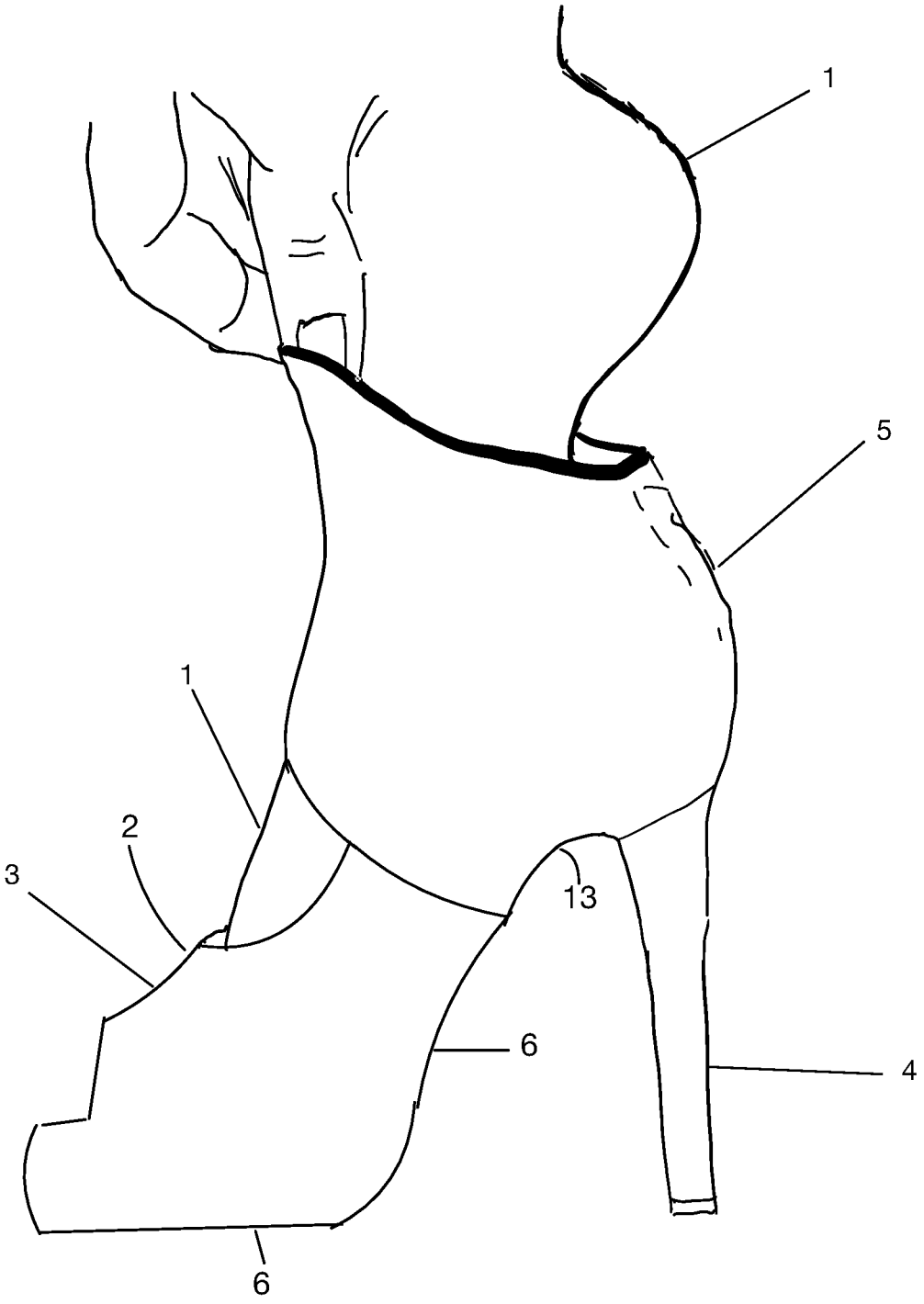
FIG. 6 illustrates the shoe garment positioned over the shoe, and shows the user's foot being inserted into the shoe garment and shoe.
Figure 7:
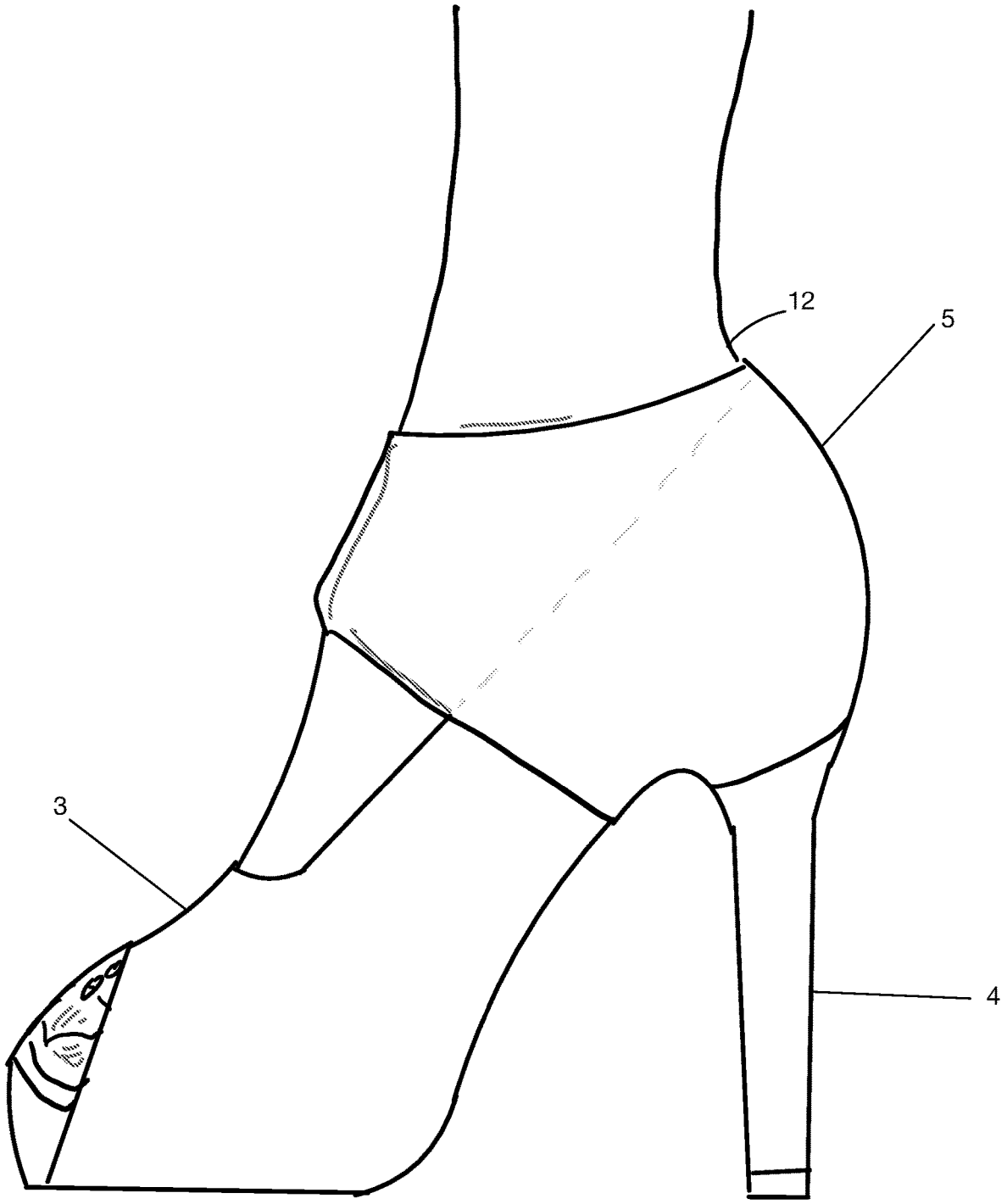
FIG. 7 illustrates the shoe and shoe garment worn by a user.

According to various embodiments, a user may wear garment 5 by first inserting heel 4 of shoe 2 into bottom support slot 10 and back out through heel slot 9, and pulling the heel through the garment (see FIGS. 3 and 4). The user may then pull garment 5 over the rear-foot side 15 of the shoe, wherein the top support slot 11 may be positioned substantially over the top of the shoe (see FIGS. 5 and 6). The foot 1 may then be inserted into the shoe 2 and shoe garment 5 through the top support slot 11.

Thus, the shoe may be worn with the shoe garment 5/tubular body 5*a* generally enveloping portions of the shoe, foot, ankle, and/or leg. The bottom support slot 10 may wrap around a portion of the foot and/or shoe. Additionally, the heel slot 9 may envelope at around a top portion of the heel and/or around a transition section 16 between the heel 4 and sole 6. In some embodiments, seamed section 13 may also cover the inner section of the heel 4 and/or transition section 16. In some embodiments, seamed section 13 may be stretchable at least in a direction perpendicular to the length and width of the garment, in order to provide coverage over the width of the bottom of the sole 6 and/or transition section 16. Furthermore, top support slot 11 may encircle above the heel portion of the foot. In some embodiments, the top support slot 11 may encircle at around the user's ankle, or may extend or be pulled higher depending on the length of the garment.

It shall be appreciated that while the shoe depicted in the figures has an upper which partially covers the top portion of the foot, in some shoes, the upper 3 may cover the mid-foot to rear-foot entirely. Other shoes may have an upper 3 which leaves the mid-foot to rear-foot entirely uncovered, and as such, the bottom support slot 10 of tubular body 5*a* may envelope only the shoe sole 6 with the foot 1 while slot 9 encircles heel 4.

According to various embodiments, while the garment 5 may generally be formed as a tubular sleeve, it may include curvature to match a shoe style and/or foot configuration. For example, as best depicted in FIG. 2, garment 5 may include contoured section(s) 14 that may conform to the rear-foot side 15 of the shoe and/or foot, according to the design of the shoe.

Furthermore, it shall be appreciated that various design elements, including contours, cut-outs, colors, ornamental features, various garment lengths, and the like, may be incorporated into the garment, depending on shoe design, user preference, etc., without departing form the inventive concept.

Additionally, the disclosed shoe garment may be used for shoes of various styles including, shoes with straps, open or closed toe shoes, shoes with various cutouts in the shoe body, etc., according to various embodiments. The shoe garment 5 may be designed in various lengths, for example, it may be cut below the ankle, or extend above the ankle (e.g. up to the calf or knee), according to various embodiments.

According to an exemplary embodiment, the shoe garment may be sewn from a fabric using a pattern. In some embodiments, exterior seams may be applied to prevent fraying. In further embodiments, elastic may be added to various seams to achieve a more fitted look. Various tailoring technics and element, such as finishing seams, elastic elements, ornamental embellishments, various types of threads, fabrics, etc. may used, depending on factors such as design preferences, style, size, type of shoe, etc. as is known in the art.

According to various embodiments, the disclosed shoe garment, and method may be used to achieve one or more of the following: to effectively secure the foot to the shoe and/or improve fit; to enhance or change the appearance/style of the shoe, thus providing the user with alternate style options for their shoe; to provide added warmth to the foot, ankle, and/or leg of the wearer; and/or to provide added support to the leg and/or ankle of the wearer.

The constituent elements of the disclosed device and system listed herein are intended to be exemplary only, and it is not intended that this list be used to limit the device of the present application to just these elements. Persons having ordinary skill in the art relevant to the present disclosure may understand there to be equivalent elements that may be substituted within the present disclosure without changing the essential function or operation of the device. Terms such as 'approximate,' 'approximately,' 'about,' etc., as used herein indicate a deviation of within +/−10%. Relationships between the various elements of the disclosed device as described herein are presented as illustrative examples only, and not intended to limit the scope or nature of the relationships between the various elements. Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A method for wearing a shoe, the shoe having a shoe heel, the method comprising:

inserting the shoe heel into a heel slot of a shoe garment, and inserting a foot into the shoe through a top support slot of the shoe garment, wherein the shoe garment comprises a generally continuous tubular body made of a stretchable fabric configured to envelop a portion of the shoe and to anchor to the heel of the shoe, the tubular body being free of any closure elements and configured to tightly wrap around the shoe and continuously extend from around a top portion of the heel to a rear-foot side of the shoe;

wherein the tubular body comprises a top opening defining the top support slot, and a bottom opening facing opposite the top opening, wherein the bottom opening includes a laterally adjoined section which joins opposing sides on a circumference of the bottom opening to form the heel slot and a bottom support slot on opposite sides of the laterally adjoined section and within the bottom opening, wherein the heel slot and bottom support slot are coplanar to one another and generally parallel to the top opening, wherein the longest dimension of the laterally adjoined section extends laterally along the circumference of the bottom opening, wherein the laterally adjoined section is configured to stretch across and continuously cover a transition section between the heel and sole of the shoe, and wherein the shoe garment is configured to leave the heel of the shoe essentially uncovered.

2. The method of claim 1, wherein the shoe garment is further configured to envelop around an exposed portion of the foot and/or ankle.

3. The method of claim 1, wherein the method is used for at least one of the following:

a. to improve the fit of the shoe, b. to effectively secure the shoe to the foot for an improved fit, c. to change the appearance of the shoe, d. to provide added warmth to the foot, ankle, leg, or combination thereof, e. to provide added support to the leg, ankle, or both, and f. to prevent shoe slippage.

4. A shoe garment configured to be worn around a shoe, the shoe including a shoe heel, the shoe garment comprising:

a continuous tubular body made of a stretchable fabric, the tubular body being free of any closure elements and comprising a top opening defining a top support slot, and a bottom opening opposite the top opening, the bottom opening including a heel slot and a bottom support slot, the heel slot being configured to receive the shoe heel, and to leave the shoe heel essentially uncovered;

a laterally adjoined section within the bottom opening, wherein the laterally adjoined section joins opposing sides on a circumference of the bottom opening to form the heel slot and the bottom support slot on opposite sides of the laterally adjoined section and within the bottom opening, wherein the heel slot and bottom support slot are coplanar to one another and generally parallel to the top opening wherein the longest dimension of the laterally adjoined section extends laterally along the circumference of the bottom opening, and is configured to stretch across and continuously cover a transition section between the shoe heel and a bottom sole of the shoe when the shoe garment is worn around the shoe, wherein the bottom support slot is generally configured to encircle a portion of the shoe and/or foot of a user, wherein the top support slot is configured to encircle the user above the foot, and wherein the shoe garment is configured to stretchably envelop and tightly wrap around a portion of the shoe, wherein the shoe garment is further configured to continuously extend from around a top portion of the heel to a rear-foot side of the shoe and to anchor to the heel of the shoe.

5. The shoe garment of claim 4, wherein the shoe garment is further configured to envelop an exposed portion of the foot.

* * * * *